United States Patent [19]

Pappas

[11] Patent Number: 4,927,140

[45] Date of Patent: May 22, 1990

[54] CONVERTIBLE BILLIARD TABLE

[76] Inventor: Spilios A. Pappas, 4233-24th St., San Francisco, Calif. 94114

[21] Appl. No.: 383,016

[22] Filed: Jul. 21, 1989

[51] Int. Cl.[5] ..... A63D 15/04

[52] U.S. Cl. ..... 273/4 R; 273/5 R; 273/8; 273/14

[58] Field of Search ..... 273/4 R, 4 B, 4 C, 5 R, 273/5 B, 5 C, 8, 14, 126 R, 126 A

[56] References Cited

U.S. PATENT DOCUMENTS

| | | | |
|---|---|---|---|
| 980,142 | 12/1910 | Byner | 273/4 A |
| 1,070,592 | 8/1913 | Fay | 273/4 R |
| 3,415,478 | 12/1968 | Williams, III | 273/126 A |
| 4,063,728 | 12/1977 | Zemanek | 273/5 A |

FOREIGN PATENT DOCUMENTS 2381539 9/1978 France .

*Primary Examiner*—Edward M. Coven
*Assistant Examiner*—Raleigh W. Chiu
*Attorney, Agent, or Firm*—Douglas E. White

[57] ABSTRACT

A game table has a rectilinear bed with a playing surface adapted to the game of billiards. Four circumferential rails are moveable from a first to a second or third position. In the first position, pockets are formed at the corners of the playing surface and at the centers of two edges thereof, whereby the game of pocket billiards may be played. In the second position, the notches in the bed for forming the pockets are covered, whereby the game of carom billiards may be played. In the third elevated position, in which the rails are elevated, air panels may be laid on the bed, whereby the game of air hockey played.

14 Claims, 5 Drawing Sheets

CONVERTIBLE BILLIARD TABLE

FIELD OF THE INVENTION

This invention relates to table games, more particularly to a billiard table which may be converted from a carom game configuration to a pocket game configuration and may also be converted to an air hockey game.

BACKGROUND OF THE INVENTION

A billiard table is so large and unwieldy that it represents a significant and relatively permanent commitment of floor space. This is one reason that such tables have not found wide acceptance in the home market. Accordingly, a great deal of effort has been directed toward adapting such a table so that it may be used to play more than one game and thereby reach a larger audience.

Prior developments in this field may be generally illustrated by reference to the following patents:

| Patent No. | Patentee | Issue Date |
|---|---|---|
| 2,381,539 France | Chevallier | 09/22/78 |
| 3,988,021 | Grover | 10/26/76 |
| 3,955,291 | Michaud | 05/11/76 |
| 3,954,267 | Freeman et al. | 05/04/76 |
| 3,429,544 | Williams III | 02/25/69 |
| 3,887,187 | Crossman et al. | 06/03/75 |
| 4,017,078 | Goldfarb | 04/12/77 |
| 4,063,728 | Zemanek | 12/20/77 |
| 853,316 | Nix | 05/14/07 |
| 895,110 | Schneider | 08/04/08 |
| 923,249 | Davenport | 06/01/09 |
| 1,157,940 | Hjort | 10/26/15 |
| 1,220,846 | Hobbs | 03/27/17 |
| 2,309,214 | Rey | 01/26/43 |
| 980,142 | Byner | 12/27/10 |
| 982,421 | Freed | 01/24/11 |
| 1,070,592 | Fay | 08/19/13 |

Pat. Nos. 2,381,539 (France) and 4,063,728 teach converting a pool (pocket billiard) table to a billiard (carom billiard) table. Pat. No. 1,070,592 shows a reversible frame, but does not show the reversible cushion aspect of the present invention.

Pat. No. 3,988,021 teaches a wheeled support. Pat. No. 2,309,214 shows a cam and plunger mechanism for moving hinged castors against the floor for transporting various large articles and machines, including tables.

Pat. Nos. 3,954,267, 3,887,187 and 4,107,078 teach game board surfaces designed to play air hockey, but they are not taught in combination with a billiard table.

The rest of the patents are representative of what is in the art.

SUMMARY OF THE INVENTION

The present invention comprises a billiard table which has reversible cushions. That is to say, when the rails containing the elastic cushions off which the playing balls carom are in a first position, pockets are formed at the corners of the interior cushion edges at the junction of the side and end rails and at the center of the side rails so that one may play the games of pocket pool or pocket billiards (both are hereinafter referred to as "pocket billiards," although the rules of play differ somewhat).

The cushions may be detached from the playing surface of the bed and rotated to a second position wherein the elastic cushions, which faced inwardly in the first position, now face outwardly and vice versa. No pockets are formed along the interior cushions in the second position and the game of carom billiards may be played.

Furthermore, when the cushions are in the second, pocketless position, and raised upwardly by suitable spacing brackets into a third position, removeable panels with small air holes in their upper surfaces may be placed over the bed. Air hoses lead from a blower and direct air out of the holes in the removeable panels so that the game of air hockey may be played with flat disks which float on a bed of compressed air above the panels.

The table may include a pneumatic jack or a screw jack which raises and lowers a wheel carriage so that the game table may be rolled to a new location when the carriage is lowered and may be firmly secured when the carriage is raised.

FEATURES AND ADVANTAGES

An object of this invention is to allow either the game of pocket billiards or the game of carom billiards to be played on one game table. Accordingly, rotatable rails have pocket-forming notches for playing pocket billiards on only one side. The rails have cushions on each side, but the cushion of the side opposite that with pocket notches forms an unbroken line for playing carom billiards.

Another object is to disclose apparatus for conveniently rotating the rails from one position to another and for securing them tightly in the chosen position. Adjustable rail brackets may be pinned to rail supports and secured to the rails by means of swivel nuts.

Yet another object is to disclose a retractable wheel carriage underneath the bed for raising and lowering wheels with which to move the table.

A further object is to disclose a table which is also able to be converted to air hockey play. Perforated panels may be laid on the table bed after the rails have been raised upwardly through reversal of the rail brackets.

Yet another object is to allow the rails to be interconnected smoothly at the corners. Accordingly, cooperating perpendicular end miters are disclosed.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, the words "upwardly," "downwardly," "leftwardly," and "rightwardly" will refer to directions in the drawings to which reference is made. The words "inwardly" and "outwardly" will refer to directions toward and away from, respectively, the geometric center of a device and designated parts thereof.

DRAWING REFERENCE NUMERALS

Figure 1:
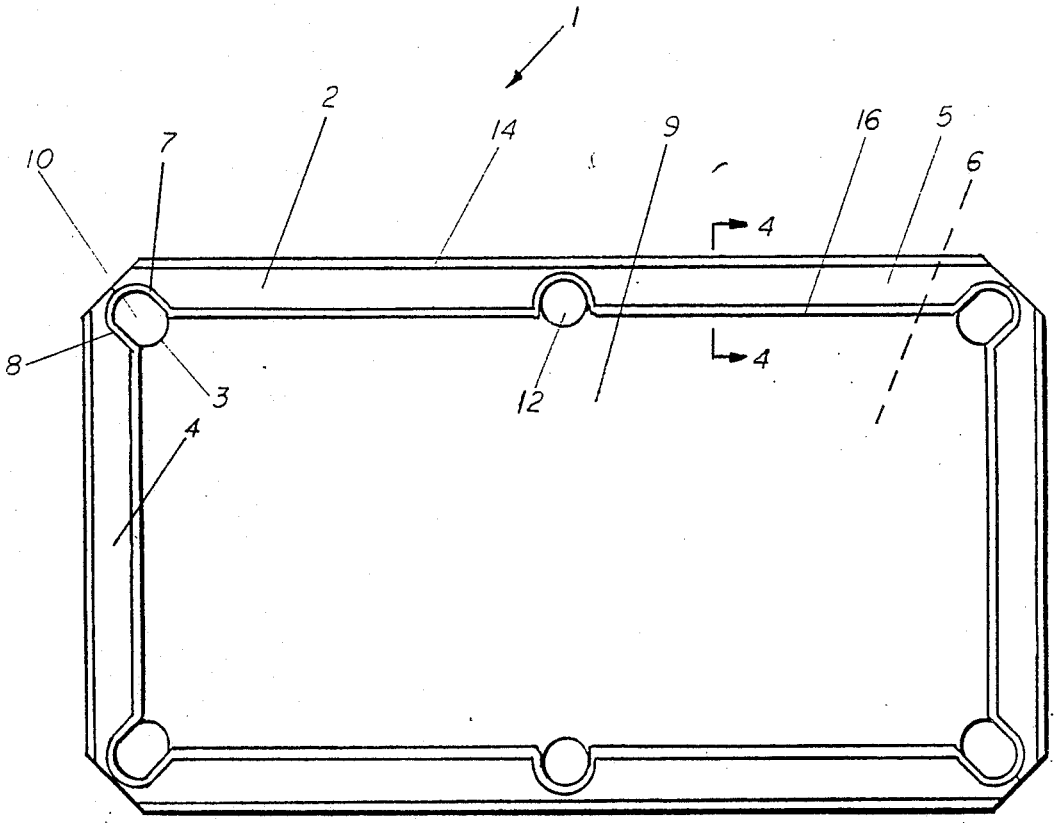
FIG. 1 is a plan view of a billiard table of this invention.

1: billiard table
2: side rail
4: end rail
3: notch in 6
5: cover
6: bed
7: notch in 2
8: notch in 4
9: felt
10: corner pocket
12: side pocket
14: carom cushion
16: pocket cushion
20: rail support
22: slot in 20
24: rail bracket
26: spacing wall of 24
28: brace of 24
32: pin
33: cord of 32
34: pinning flange of 24
36: horizontal aperture in 20
37: vertical aperture in 34
38: vertical aperture in 20
39: horizontal aperture in 26
40: swivel bolt
42: mount of 40
44: thumb nut of 40
48: flange of 2
60: air panel
61: hockey goal
62: perforations in 60
64: hose coupling
66: air hose
68: blower
69: mount for 68
80: wheel carriage
81: wheel
82: jack
84: stretcher bar of 80
86: wheel bar of 80
88: stabilizer
89: spring
90: leg
91: leg rest
92: decorative panel

DESCRIPTION OF A PREFERRED EMBODIMENT

Referring to FIG. 1, there is illustrated therein a billiard table 1 of my invention set up in a first position on which the game of pocket billiards may be played.

The playing surface consists of a bed 6 made of wood, slate or other suitable hard planar material and covered with wool felt 9 or other cloth to form a playing surface. The table will be described with respect to a single pair of side 2 and end 4 rails, it being understood and visible in the drawing that the table comprises an additional side rail and an additional end rail, which rails are parallel to and on opposite sides of the table from the corresponding rails 2,4.

In the first position, matched curvilinear notches 7,8 in the ends of rails 2,4, respectively, co-operate with a notch 3 in the corner of the bed to form a corner pocket 10 into which balls may be directed during play. A separate center notch in the side rail 2 uncovers a side pocket 12. Felt covered rubber cushions 14,16 line the long lateral sides of the rails to smoothly deflect balls. In between the cushions, the bare wood of the rail may be decorated by a plastic cover 5, or painted, as desired. In the pocket billiard position shown in FIG. 1, the side rail 2 has its notched pocket cushion 16 directed toward the bed and its straight carom cushion 14 directed outwardly, where the latter is out of play.

Figure 2:
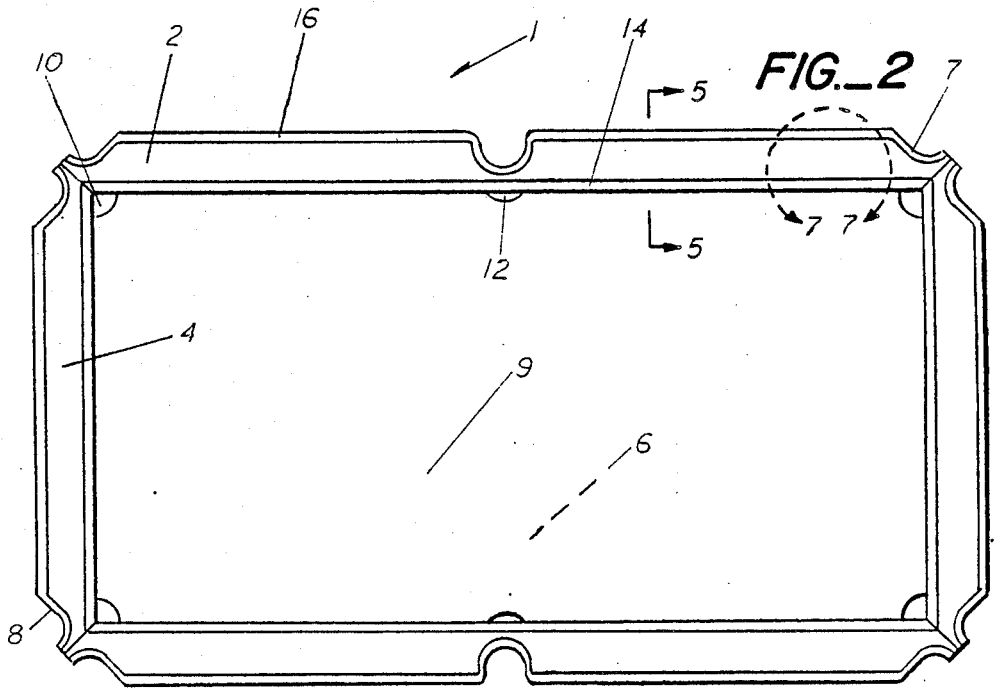
FIG. 2 is a plan view of the table of FIG. 1 in a second position.

Turning to FIG. 2, one can see the results of removing rails 2,4, turning them clockwise or counter-clockwise about vertical center axes, and then re-attaching them adjacent to the bed 6 in a second position for playing carom billiards, a game wherein pockets are absent. In the carom billiard position of the table 1 which is shown in FIG. 2, the side rail 2 has its unnotched straight carom cushion 14 directed toward the playing surface of the bed and its pocket cushion 16 directed outwardly, where the latter is out of play.

The ends of the rails are mitered at 135 degree angles with respect to the carom cushion sides so that a smooth joint is formed at the corners of the table when in the carom position. An additional small miter extends off of the main miter at 90 degrees to form a short smooth joint at the rear of the pocket notches 7,8 when the table is in the pocket position.

When the table is in the carom playing position, portions of the notches along the edges of the bed 6 (which notches form pockets 10,12 in the pocket playing position) may still protrude slightly beyond the carom cushion 14 (shown exaggerated in FIG. 2 for illustration). However, the playing balls are of sufficient diameter as not to engage them. Alternatively, the rails 2,4 may be constructed so that the pockets do not protrude at all in the second position.

Next, referring to FIGS. 4–7, the apparatus for removably attaching the rails 2,4 to the table will be discussed.

Figure 3:
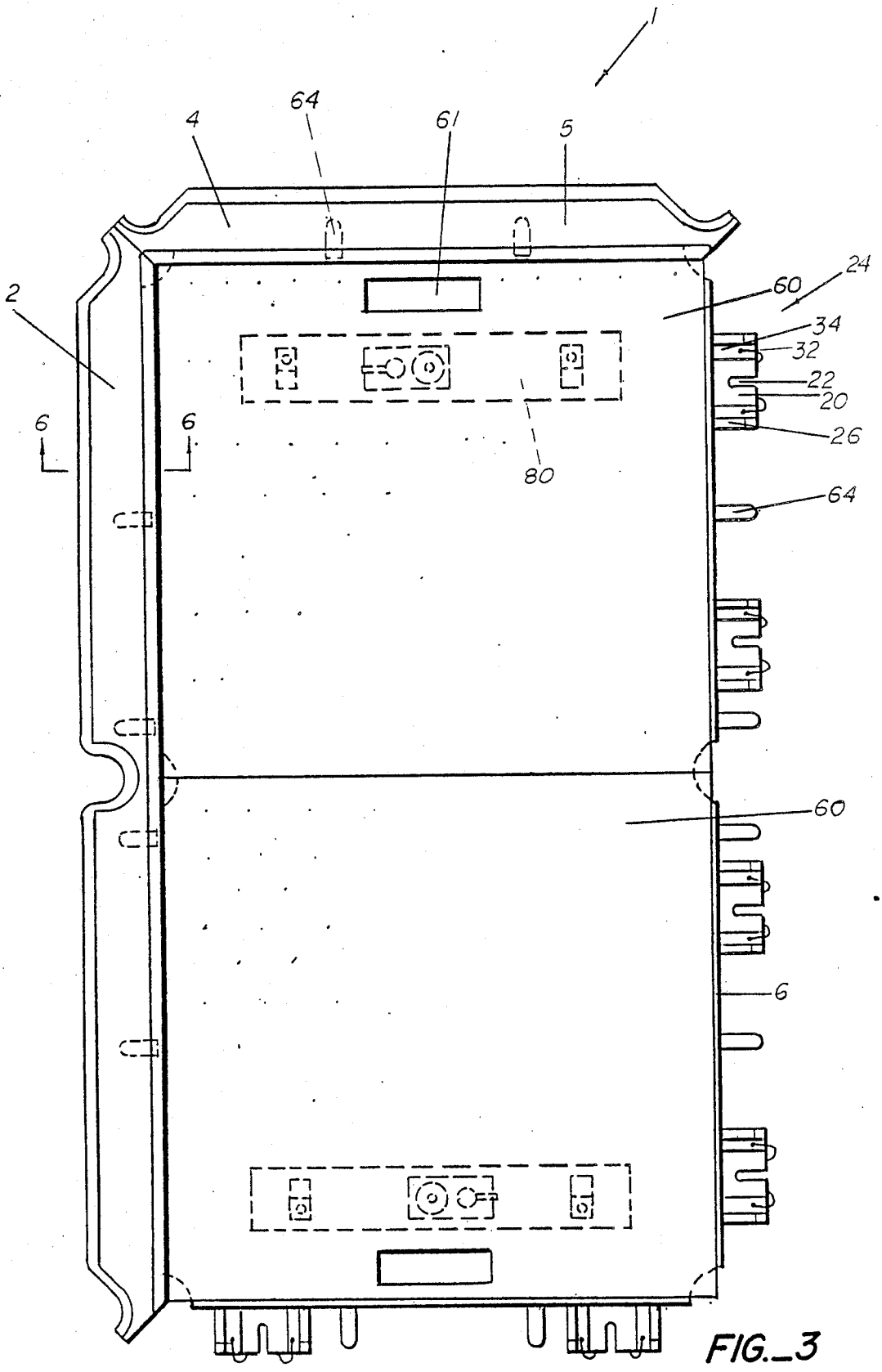
FIG. 3 is an enlarged plan view of the table with air panels in place and with a side rail and an end rail removed.
Figure 4:
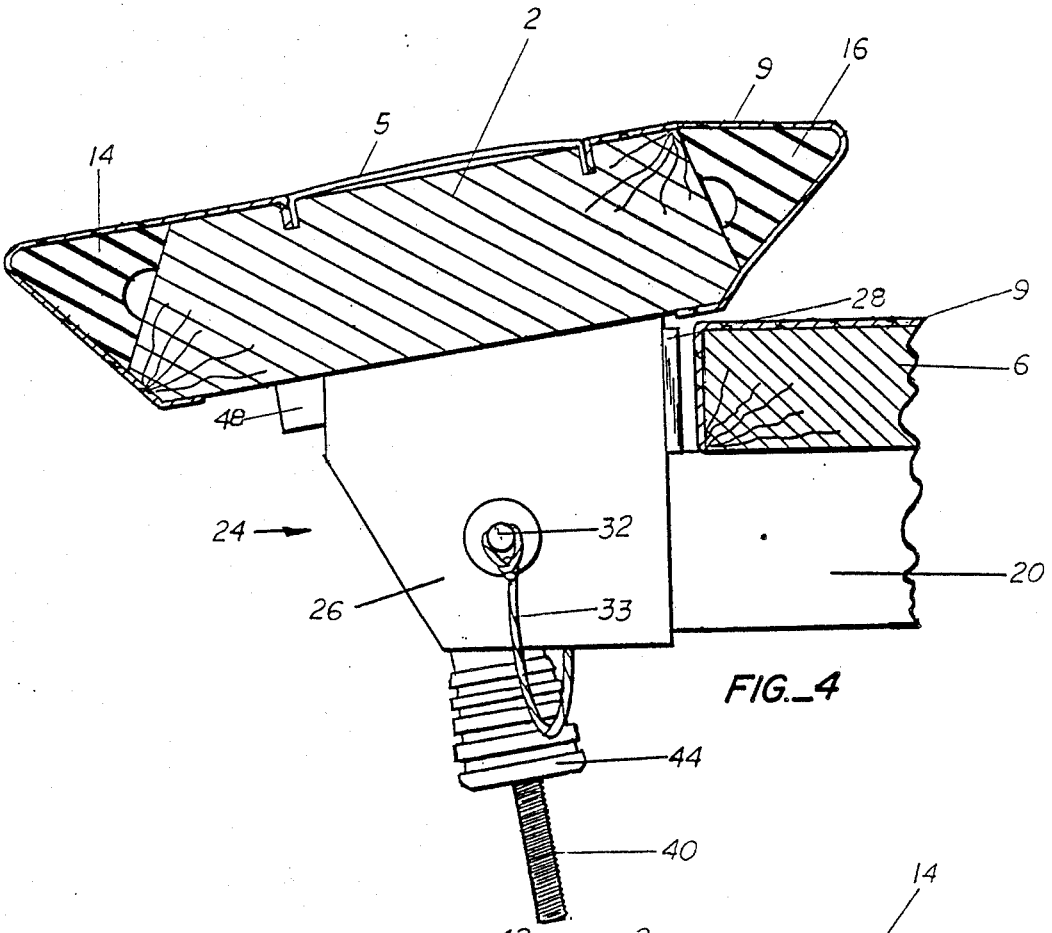
FIG. 4 is a greatly enlarged fragmentary sectional view of a rail bracket taken along line 4—4 of FIG. 1.

When the table is in the first, pocket billiards, position, as shown in FIG. 1, the side rail 2 is attached adjacent to the bed 6 in the manner shown in FIG. 4, namely, with the pocket cushion 16 facing the bed. Underneath the bed are a series of cross-pieces or rail supports. Rail support 20 extends outward beyond the bed and to it is removably pinned a rail bracket 24. In all, there are preferably two rail brackets for each end rail and four rail brackets for each side rail, as best seen in FIG. 3.

Figure 5:
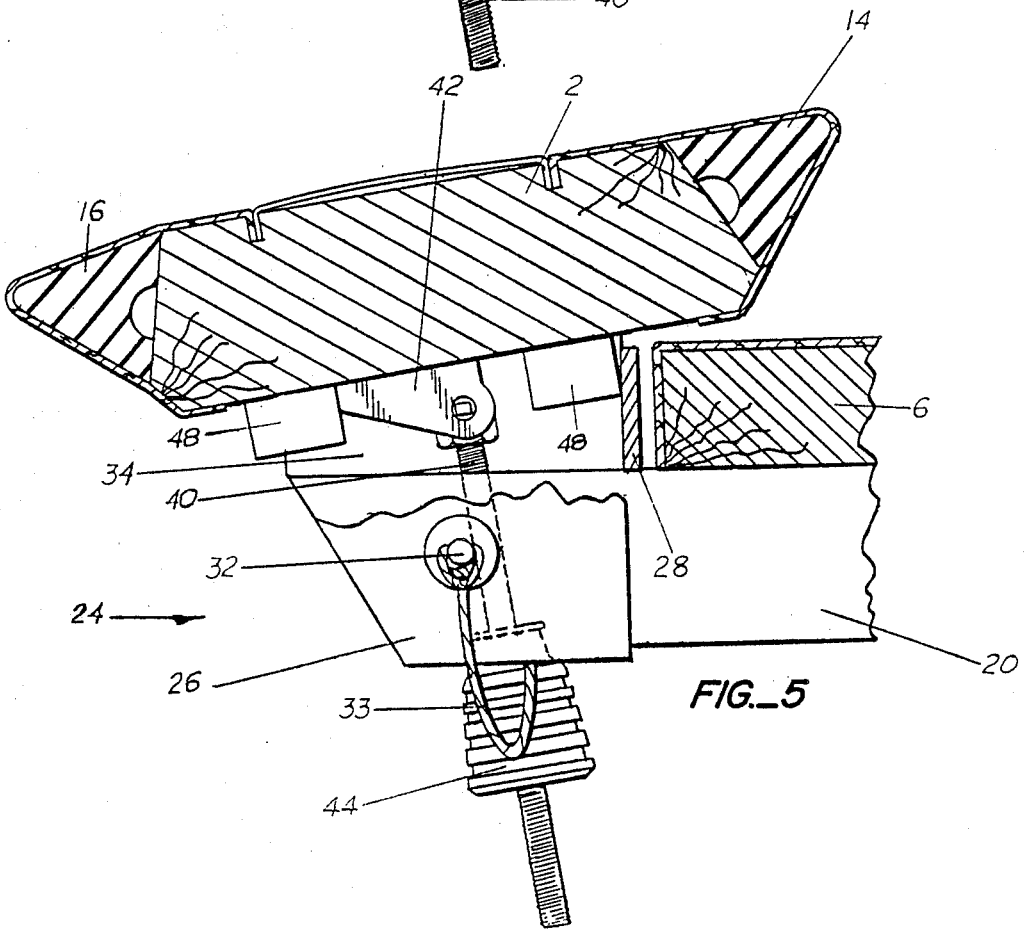
FIG. 5 is a fragmentary sectional view of the bracket of FIG. 4 in a second position, taken along line 5—5 of FIG. 2.

FIG. 5 shows the same rail support 20 when the table is set up in the second, carom billiards, position as previously discussed with reference to FIG. 2, namely, with the carom cushion 14 facing the bed.

The rail bracket 24 is comprised of two parallel and congruent planar spacing walls 26 connected by a bracket brace 28. The walls and brace cooperate to support the rail 2 in various heights and positions depending on the game to be played.

Figure 7:
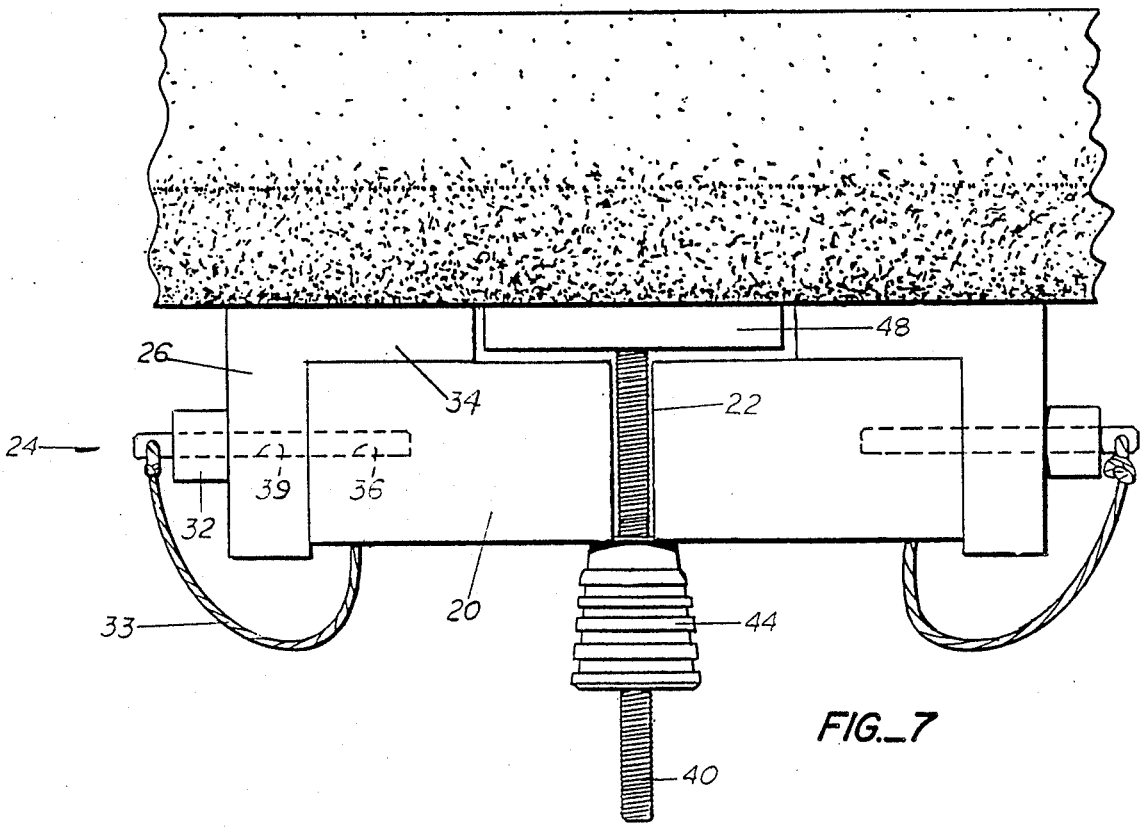
FIG. 7 is an alternate fragmentary view of the bracket in the position of FIG. 5, but taken along line 7—7 of FIG. 2.

Removeable pins 32, affixed to the rail support by cords 33, extend through horizontal apertures 39 in the spacing walls 26 into horizontal apertures 36 in the rail support 20, as best seen in FIG. 7, which is a view of the bracket 24 taken at right angles to that of FIG. 5.

The bottom of the rail 2 has affixed a bolt mount 42 from which a swivel bolt 40 rotates downwardly. On both sides of the bolt mount a pair of rail flanges 48 extend parallel with the bracket brace 28. One or the other of these flanges solidly abuts the brace when the rail is in either of the two billiard game positions.

The swivel bolt 40 readily slides in and out of an open faced slot 22 in the end of the rail support 20 when the rail is moved from one game position to another. A thumb nut 44 is used to tighten the bracket and rail against the rail support.

A pair of horizontal flanges 34 extend inwardly toward each other perpendicular to the bracket walls 26. The bracket rests on the rail support against either the top surfaces or the bottom surfaces of the flanges 34, depending on whether a billiard game or an air hockey game is to be played, as best seen in FIGS. 5–7.

Figure 6:
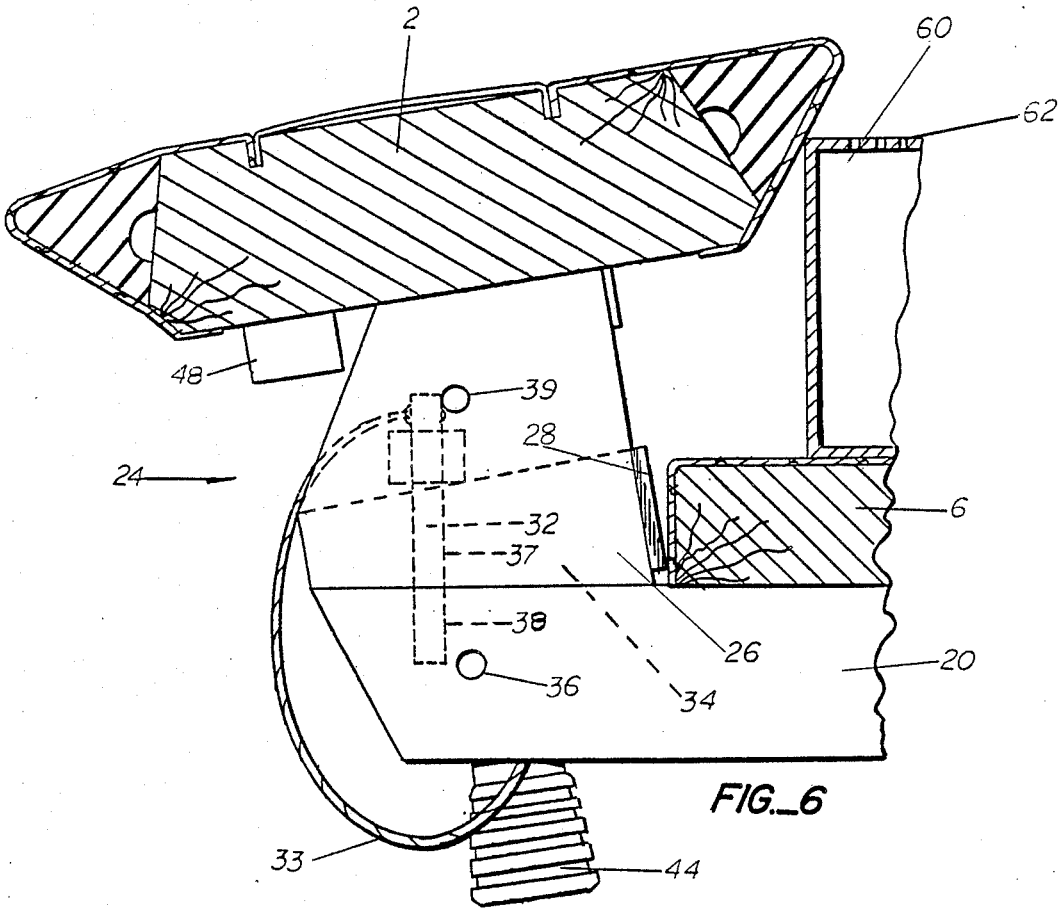
FIG. 6 is a fragmentary sectional view of the bracket in a third position, taken along line 6—6 of FIG. 3.

Turning to FIG. 6, it can be seen that the rail bracket is turned upside down when air hockey is to be played. This has the effect of raising the rail a significant distance above the bed 6 in order that a pair of air permeable panels 60 can be placed thereupon. In this position, the bracket is pinned in place by inserting the pins 32 through vertical apertures 37 in the pinning flanges 34 and into vertical apertures 38 in the rail support 20. At least one panel 60 has a multiplicity of regularly and closely spaced small perforations 62 through which air may be forced to float a disk or "puck" (not illustrated) during a game of air hockey. Preferably, there are two panels 60 for more convenient storage thereof when not in use.

Figure 8:
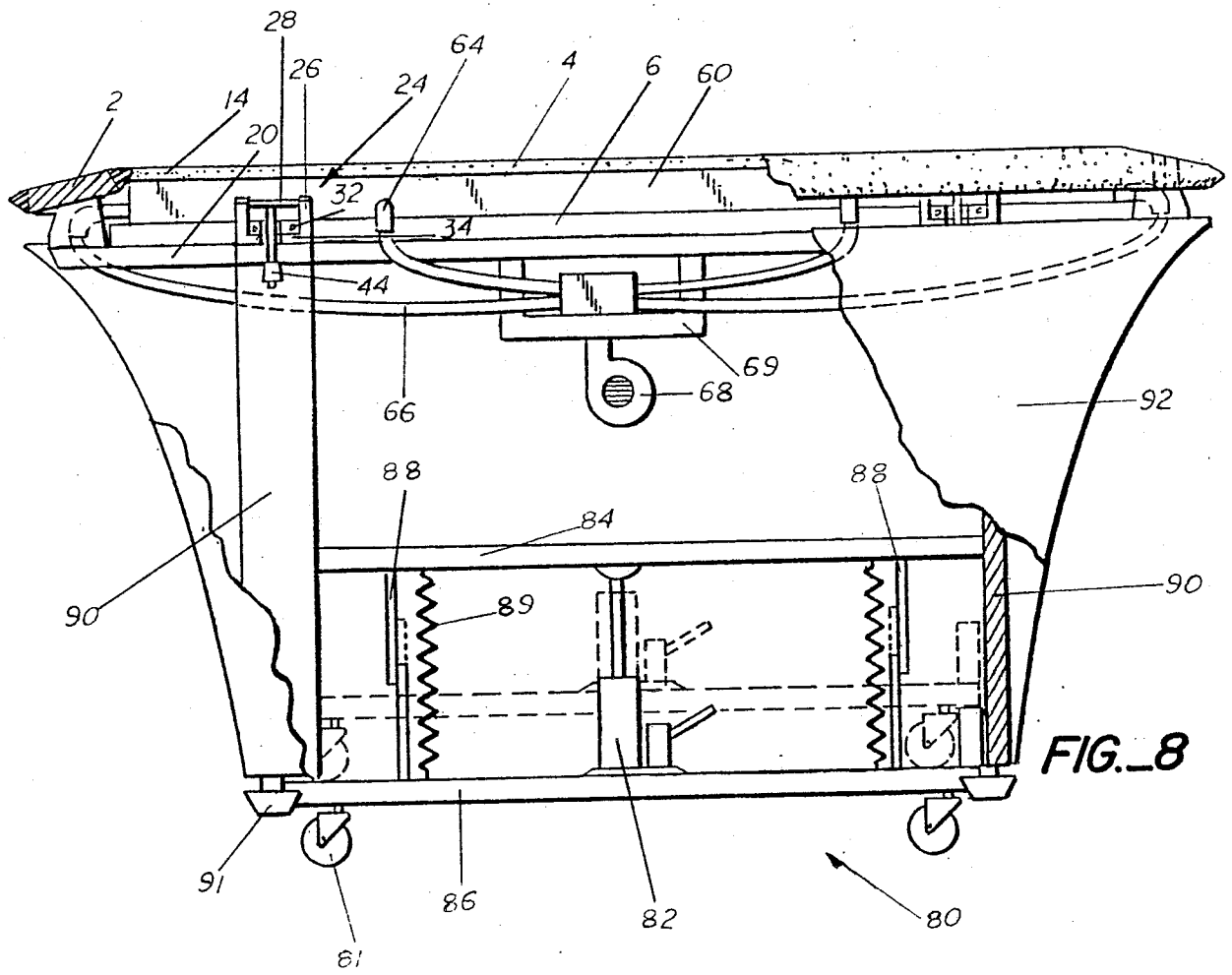
FIG. 8 is a broken side elevation of the table in the air hockey configuration of FIG. 3.

Turning to FIGS. 3 and 8, the remainder of the hockey game configuration can be visualized. At each end of the table 1, a hockey goal 61 for trapping pucks is built into the corresponding air panel 60. Underneath the bed of the table, an air blower 68 is attached with a suitable mount 69. Air hoses 66 lead from the blower to hose couplings 64 at evenly spaced positions in the sides of the permeable panels 60. Air currents produced by the blower float the puck above the surface of the panels, whereupon it caroms freely off the cushioned rails 2,4.

Another feature of the present table 1 is a wheel carriage 80 which is used to raise and lower wheels 81 with a pneumatic jack 82 or, alternatively, with a screw jack. The cylinder of the jack presses upwardly on a horizontal stretcher bar 84 which is rigidly affixed to the legs 90 of the table or to the table frame. The base of the jack 82 is mounted on a wheel bar 86 which carries the wheels 81.

When the jack is retracted, the table sets on leg rests 91 and, due to its extreme weight, is nearly immovable. However, when the cylinder of the jack is extended, the wheels lower, the stretcher bar 84 forces the table up off the leg rests, and the table may be rolled to a new position. A pair of telescoping stabilizers 88 maintain the wheel bar 86 and stretcher bar 84 in stable horizontal relationship. If necessary, means such as springs 89 can be added to assist the wheel bar in retracting when the jack is released.

Hinged or removeable decorative panels 92 are added to skirt the four sides of the table and conceal air hoses, rail brackets, ball returns (not illustrated) and the like.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. For example, decorative covers could be provided for emplacement over the rail notches when the rails are in the carom position. Therefore, the above description and illustrations should not be construed as limiting the scope of the invention which is defined by the appended claims.

I claim:

1. A game table including:
a rectilinear bed having four edges bounding an upper playing surface;
curvilinear bed notches in the four corners of the bed and in the center of two opposing edges; and
four rails moveable from a first to a second position, each position having one rail adjacent and parallel to each edge, the rails having
opposing and parallel first and second long sides each, and
generally curvilinear rail notches at the ends of the rails on the first side and in the center of two of the rails on the first side,
wherein
pockets are formed by the bed notches and adjacent rail notches when the rails are in the first position with the first sides facing the playing surface
and wherein
no pockets are formed when the rails are in the second position with the second sides facing the playing surface.

2. The apparatus of claim 1 further including:
a flexible pocket cushion on each first side; and
a flexible carom cushion on each second side.

3. The apparatus of claim 2 further including:
adjustable rail brackets removably mounted on rail supports adjacent to the bed edges, the rail brackets adapted to support the rails in the first and second positions.

4. The apparatus of claim 3 further including:
a retractable wheel carriage underneath the bed for raising and lowering wheels with which to move the table.

5. The apparatus of claim 3 further including:
first miters on the ends of the rails intersecting the second sides at 135 degree angles.

6. The apparatus of claim 5 further including:
second miters on the ends of the rails intersecting the first miters at 90 degree angles.

7. The apparatus of claim 2 wherein:
the four rails are moveable to a third position with the second sides facing the playing surface and elevated with respect thereto and with respect to the second position, and further including:

at least one panel laid on the playing surface between the rails, the panel having perforations on an upper panel surface thereof; and means for forcing air through the perforations.

8. The apparatus of claim 7 wherein:

there are two panels laid adjacent to one another and the air forcing means is a blower connected by air hoses to the panels.

9. A game table including:

a rectilinear bed having four edges bounding an upper playing surface;

curvilinear bed notches in the four corners of the bed and in the center of two opposing edges; and four rails moveable from a first to a second position, each position having one rail adjacent and parallel to each edge, the rails having opposing and parallel first and second long sides each, generally curvilinear rail notches at the ends of the rails on the first side and in the center of two of the rails on the first side, a flexible pocket cushion on each first side, a flexible carom cushion on each second side, and first miters on the ends of the rails intersecting the second sides at 135 degree angles, wherein pockets are formed by the bed notches and adjacent rail notches when the rails are in the first position with the first sides facing the playing surface and wherein no pockets are formed when the rails are in the second position with the second sides facing the playing surface.

10. The apparatus of claim 9 further including:

second miters on the ends of the rails intersecting the first miters at 90 degree angles.

11. The apparatus of claim 9 further including:

a retractable wheel carriage underneath the bed for raising and lowering wheels with which to move the table.

12. The apparatus of claim 9 further including:

adjustable rail brackets removably mounted on rail supports adjacent to the bed edges, the rail brackets adapted to support the rails in the first and second positions.

13. The apparatus of claim 9 wherein:

the four rails are moveable to a third position with the second sides facing the playing surface and elevated with respect thereto and with respect to the second position, and further including:

at least one panel laid on the playing surface between the rails, the panel having perforations on an upper panel surface thereof; and means for forcing air through the perforations.

14. The apparatus of claim 13 wherein:

there are two panels laid adjacent to one another and the air forcing means is a blower connected by air hoses to the panels.

* * * * *